US006538660B1

(12) United States Patent
Celi, Jr. et al.

(10) Patent No.: US 6,538,660 B1
(45) Date of Patent: Mar. 25, 2003

(54) METHOD, SYSTEM, AND PROGRAM FOR SUPERIMPOSING DATA FROM DIFFERENT APPLICATION PROGRAMS

(75) Inventors: Joseph Celi, Jr., Bocan Raton, FL (US); Michael R. Cooper, Austin, TX (US); Joseph Kubik, Austin, TX (US); Jonathan Mark Wagner, Round Rock, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/439,050

(22) Filed: Nov. 12, 1999

(51) Int. Cl.[7] ..... G09G 5/377
(52) U.S. Cl. ..... 345/592; 345/629
(58) Field of Search ..... 345/634, 635, 345/636, 592, 639, 643, 768, 606, 629, 640, 641, 630, 765, 766; 382/178, 213, 214

(56) References Cited

U.S. PATENT DOCUMENTS

| | | | | |
|---|---|---|---|---|
| 4,317,114 A | | 2/1982 | Walker | |
| 4,555,775 A | | 11/1985 | Pike | |
| 5,202,828 A | | 4/1993 | Vertelney et al. | |
| 5,475,812 A | | 12/1995 | Corona et al. | |
| 5,559,942 A | | 9/1996 | Gough et al. | |
| 5,715,459 A | | 2/1998 | Celi, Jr. et al. | |
| 5,831,615 A | * | 11/1998 | Drews et al. | 345/768 |
| 5,936,641 A | | 8/1999 | Jain et al. | |
| 5,999,191 A | * | 12/1999 | Frank et al. | 345/634 |
| 6,151,030 A | * | 11/2000 | DeLeeuw et al. | 345/592 |

OTHER PUBLICATIONS

"QuickTime 4 API Documentation 3D graphics Programming with QuickDraw 3D 1.5.4", developer.apple.com, 1997.

J.D. Mulder, et al. "Pixel Masks for Screen–Door Transparency", 1998, pp. 351–358 and p. 550.

D. Rogerson, "OpenGL V: Translating Windows DIBs", msdn.microsoft.com, 1999, pp. 1–16.

"The PC Technology Guide", pctechguide.com, Aug. 26, 1999, pp. 1–7.

"Display Drivers", Microsoft Corporation, 1999.

"10.2 Alpha Blending", www–europe.sgi.com.

"Zdwebopedia", Zdnet, zdwebopedia.com, 1999.

"Alpha Blending", library.advanced.org.

"Alpha Blending Modes", GL3.2 Version 4.1 for AIX: Programming Concepts, rs6000.com.

* cited by examiner

*Primary Examiner*—Michael Razavi
*Assistant Examiner*—Thu Thao Havan
(74) *Attorney, Agent, or Firm*—David W. Victor; Konrad Raynes Victor & Mann LLP

(57) ABSTRACT

Disclosed is a system, method, and program for displaying data. A program receives first input graphics commands from a first application program to display first output on a display monitor and second input graphics commands from a second application program to display second output on the display monitor. The second output is graphically blended with an overlapping portion of the first output. Output graphics commands are generated from the first and second input graphics commands to display the graphically blended second output superimposed over an overlapping portion of the first output and the first output non-overlapping with the second output. This allows the content of the secondary output to be displayed without affecting user operations with respect to the primary application window.

33 Claims, 5 Drawing Sheets

METHOD, SYSTEM, AND PROGRAM FOR SUPERIMPOSING DATA FROM DIFFERENT APPLICATION PROGRAMS

BACKGROUND OF THE INVENTION

1. Field of the Invention

The present invention relates to a method, system, for program superimposing graphics from different application programs.

2. Description of the Related Art

In prior art windows operating systems environments, graphics (e.g., text and images) from two application programs may be displayed simultaneously on the screen. However, the information from the different applications is typically displayed in separate graphical windows that overlap. FIG. 1 illustrates prior art methods for displaying information from one application program while another application program is displaying a graphical user interface (GUI) window. In FIG. 1, a display monitor 2 is displaying a graphical window 4 for an application program. While the window 4 is being displayed, another application program displays information, such as a message in a dialog box or separate graphical window 6. For instance, application programs displaying information such as an e-mail notification or stock ticker typically display information in a separate graphical window, such as the window 6 shown in FIG. 2.

This prior art technique for displaying information while other application windows are being displayed could interfere with the current window in which the user is working. The display of window 6 may block the user's view of the application window 4 in which the user is working and block the user's direct access to portions of the application window 4 covered by the information window 6. In such case, the user would have to either close or drag and drop the information window 6 to another location on the screen to access areas of the application window 4 currently blocked by the displayed information window 6. For instance, a pop-up display of the information window 6 could cover the very region of the application window 4 the user is currently accessing.

Thus, there is a need in the art for an improved method, system, and program for displaying information from one program while another program is displaying information on the monitor.

SUMMARY OF THE PREFERRED EMBODIMENTS

To overcome the limitations in the prior art described above, preferred embodiments disclose a system, method, and program for displaying data. A program receives first input graphics commands from a first application program to display first output on a display monitor and second input graphics commands from a second application program to display second output on the display monitor. The second output is graphically blended with an overlapping portion of the first output. Output graphics commands are generated from the first and second input graphics commands to display the graphically blended second output superimposed over an overlapping portion of the first output and the first output non-overlapping with the second output.

In further embodiments, the generated output graphics commands are device independent graphics commands. The output graphics commands are sent to a display driver. The display driver generates device dependent display commands from the output graphics commands to control the monitor.

In still further embodiments, a blending algorithm is executed to superimpose the second output with the overlapping portion of the first output, wherein the second output is displayed as a transparency over the first output such that content of the first output is visible through the displayed second output on the display monitor.

Still further, the output graphics commands cause the display of the second output superimposed over an overlapping portion of the first output and the first output non-overlapping with the second output in a single graphical window. The first output overlapping with the second output may be directly accessible to a user through the graphical window.

Preferred embodiments provide a method, system, and program for displaying content from a secondary application over the content displayed for a primary application program in a manner that does not interfere with the user's interaction with the displayed primary application program. Preferred embodiments blend the content from the secondary application, i.e., secondary output, with the overlapping content from the primary application, i.e., primary output, to superimpose a transparency of the secondary output over the primary output. In this way, display of the secondary output does not generate new windows or otherwise interfere with the graphical user interface displaying the data from the primary application program with which the user is interacting.

BRIEF DESCRIPTION OF THE DRAWINGS

Referring now to the drawings in which like reference numbers represents corresponding parts throughout.

DETAILED DESCRIPTION OF THE PREFERRED EMBODIMENTS

In the following description, reference is made to the accompanying drawings which form a part hereof, and which illustrate several embodiments of the present invention. It is understood that other embodiments may be utilized and structural and operational changes may be made without departing from the scope of the present invention.

Figure 2:
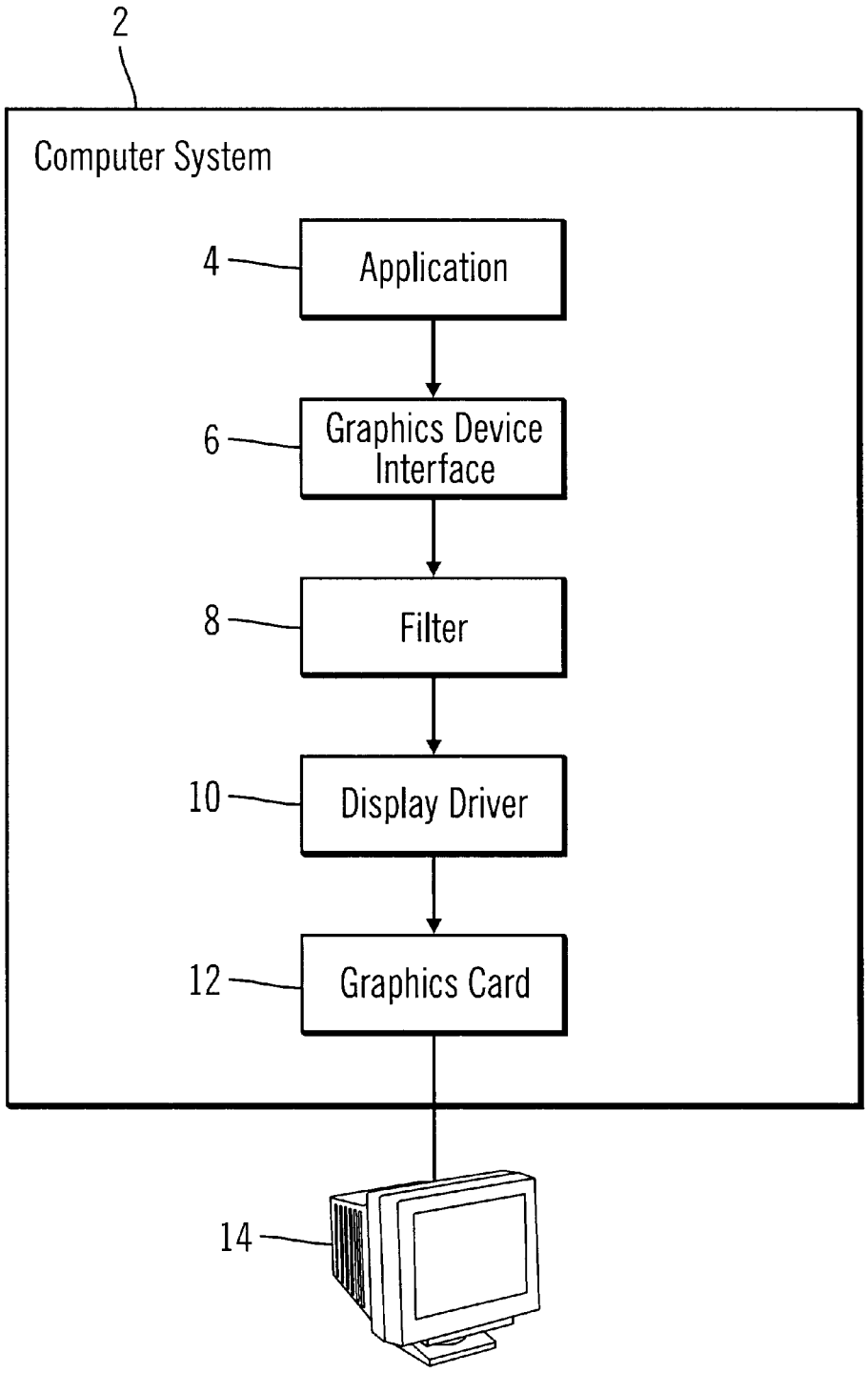
FIG. 2 illustrates a computing environment in which the preferred embodiments are implemented.

FIG. 2 illustrates a computing environment in which preferred embodiments are implemented. A computer system 2 includes an application program 4, graphics device interface 6, filter 8, display driver 10, and graphics card 12. A display monitor 14 is attached to the computer 2 and displays data in response to commands from the graphics card 12. The computer system may comprise any computer system known in the art, including a personal computer, workstation, mainframe, laptop, palmtop, server, client, etc. The computer system 2 would include an operating system capable of displaying GUI windows, e.g., Microsoft Windows 95, 98, NT, and CE; OS/2; Red Hat Linux; MAC OS, etc. The application program 4 may comprise any application program capable of executing in the computer system 2, e.g., wordprocessor, spreadsheet, calendar, game, etc. The graphics device interface 6 is a graphics engine that is typically implemented within the operating system and receives graphics commands from the application program 4 on data to output to the display 14. The term graphics command as used herein relates to commands to generate the display of text, images, video, three dimensional objects or any other displayable object known in the art. The graphics device interface 6 generates device independent renderings of graphics, e.g., drawing graphics primitives, manipulating bitmaps, etc., in a manner known in the art. The graphics device interface 6 sends the device independent renderings to the filter 8. In preferred embodiments, the filter 8 is a shared library object, such as the dynamic link library (DLL) file type used in Windows. The display driver 10 is also a shared library object and translates the device independent commands from the graphics device interface 6 into device dependent commands that can drive the graphics card 12. The graphics card 12 may comprise any display adaptor and graphics processor known in the art to execute device dependent graphics commands to control the monitor 14 to display text and/or images. The display monitor 14 may comprise any computer display device known in the art, including a CRT, LCD, touch screen, etc.

**WINDOWS, MICROSOFT, and WINDOWS NT are registered trademarks of Microsoft Corporation; OS/2 is a registered trademarks of International Business Machines Corporation; MAC is a registered trademark of Apple Computer, Inc.; Red Hat is a trademark of Red Hat, Inc.

In preferred embodiments, the filter 8 is capable of receiving as input graphics commands from multiple application programs 4, referred to herein as a primary and secondary applications, via the graphics device interface 6. The display output from the primary application, referred to herein as primary output, may be displayed in an active application window and the display output from the secondary application, referred to herein as secondary output, is to be blended with a region of the display of the primary output to superimpose the secondary output as a transparency, e.g., watermark, over the displayed primary output in the primary application window. If there are multiple windows for different application programs displayed on the monitor 14, it is possible the location coordinates of where to display the secondary output positions the secondary output in an inactive window or on the desktop. In such case, the secondary output would be blended with a region of the desktop or inactive window, without affecting the active status of the currently active window.

The filter 8 receives display output from the secondary application via the graphics device interface 6 and blends this secondary output with the primary output that overlaps the display region of the secondary output. In this way, the secondary output is displayed as a transparency or watermark over the display region of the primary application. In preferred embodiments, the user can view the content of the primary application over which the secondary output is superimposed and select the content of the primary application displayed underneath the superimposed secondary output using an input device or other graphical user interface (GUI) as if the secondary output was not displayed in the primary application window. This allows the content of the secondary output to be displayed without affecting user operations with respect to the primary application window. For instance, if the user performs an input device action over the area of the secondary output superimposed over the primary output, then the action, e.g., single or double-clicking one of the mouse buttons, will perform the action with respect to controls or commands related to the primary output instead of the superimposed secondary output.

Figure 1:
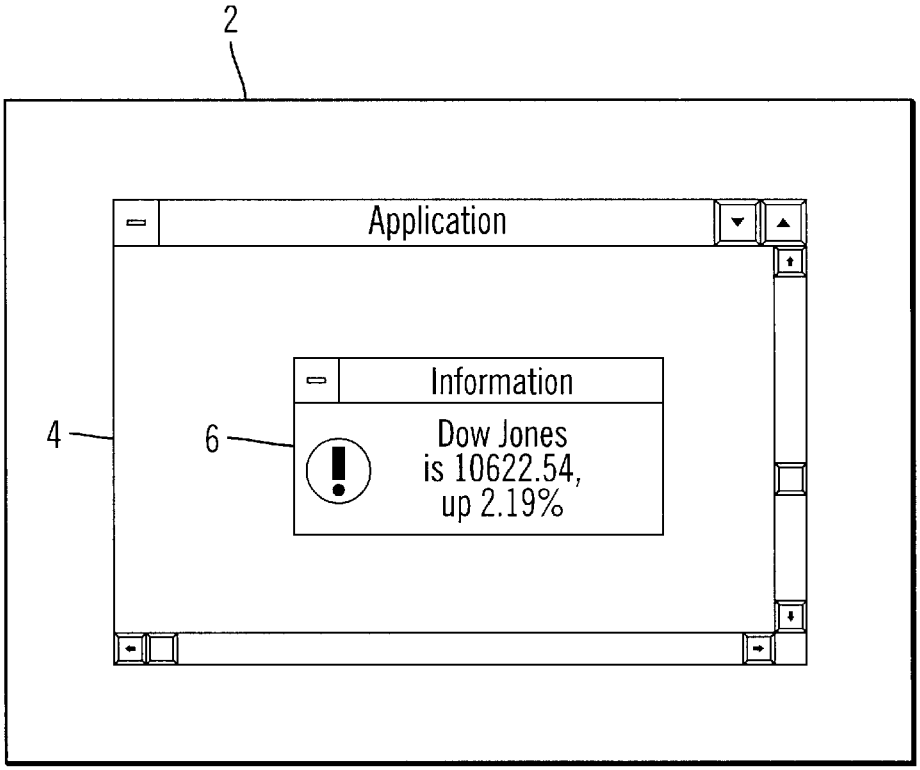
FIG. 1 PRIOR ART
FIG. 1 illustrates an example of how data from two different application programs is displayed in a manner known in the art.
Figure 3:
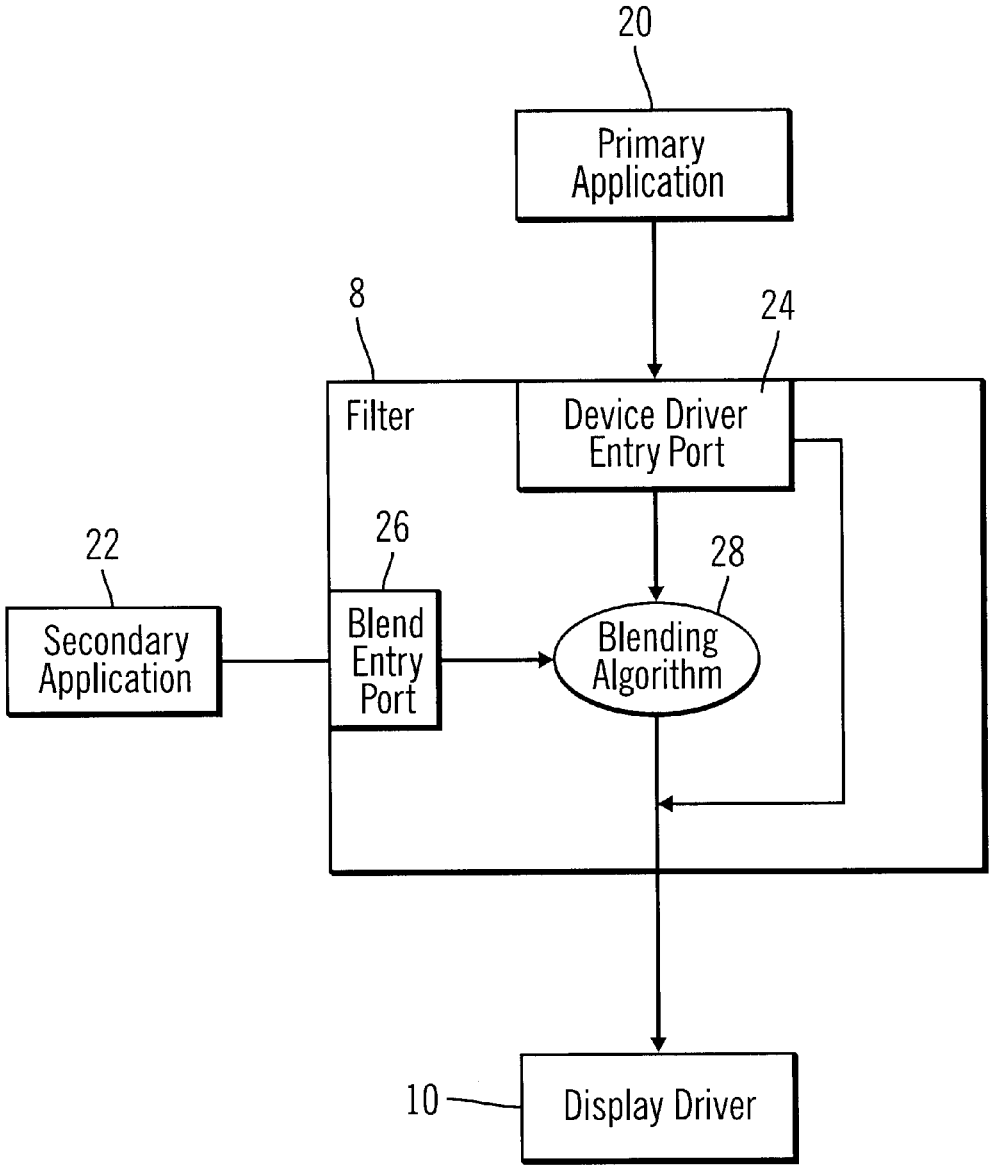
FIG. 3 illustrates the components of the filter in accordance with preferred embodiments of the present invention.

FIG. 3 illustrates components of the filter 8 to superimpose the primary and secondary output. The applications 20 and 22 would interact with the filter 8 via the graphics device interface 6 as shown in FIG. 1. An application, e.g., the primary application 20, wanting to call the device driver 10 to display the primary output in a separate graphical window of the primary application would make an API call to the filter 8 at the device driver entry port 24. An application, e.g., the secondary application 22, wanting to display secondary output superimposed over what is currently displayed without affecting the current display would make an API call to the filter 8 at the blend entry port 26. The filter 8 further includes a blending algorithm 28 to blend the primary and secondary outputs to display the secondary output superimposed as a transparency over the primary output. The blending algorithm 28 may comprise any blending algorithm known in the art, such alpha channel blending, transparency blending, screen door transparency, etc.

With the filter 8, application programs may specify how to display data by specifying a particular entry port of the filter 8. Those applications wanting to be displayed in a separate graphical window or without blending would call the filter 8 at the device driver entry port 24 and those applications that only want to display information on the monitor 14 without affecting the current operation of the displayed windows would call the filter 8 at the blend entry port 26. For instance, applications displaying the time of day, notifications of e-mail messages, calendar reminders, stock quotes, etc., may make a call to the blend entry port 26 to display their information superimposed over the current display to avoid interfering with the user's operations in the current active window.

Figure 4:
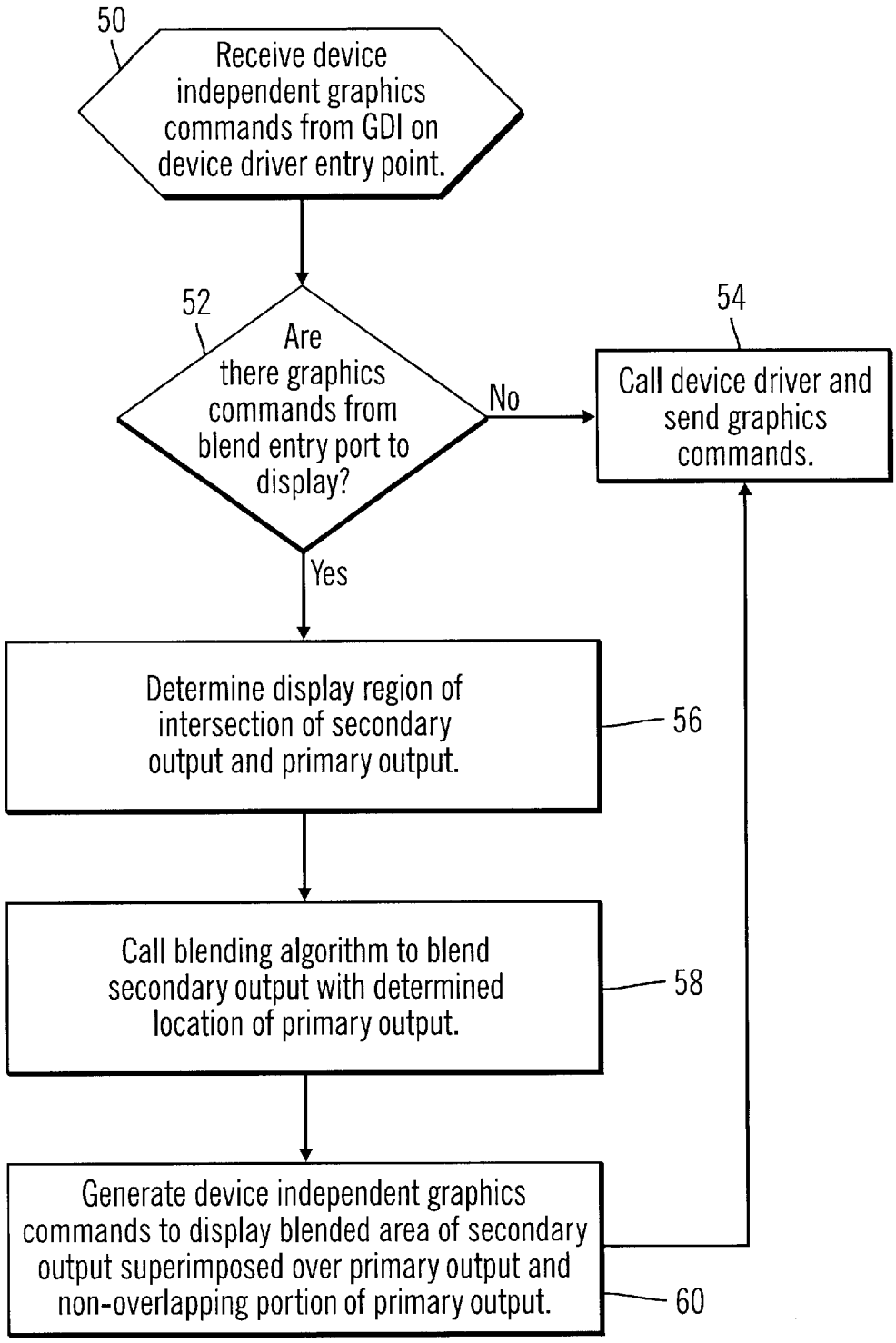
FIG. 4 illustrates logic implemented in the filter to blend graphics from two different applications in accordance with preferred embodiments of the present invention.

FIG. 4 illustrates logic implemented in the filter 8 to process device independent graphics commands from the primary 20 and secondary 22 applications via the graphics device interface 6. Control begins at block 50 with the filter 8 receiving device independent graphics command from the primary application 20 at the device driver entry port 24 via the graphics device interface 6. The graphics device interface 6 would call the filter 8 on the device driver entry port 24 to display the graphics in a separate window. Note that even if there are no application programs executing, the operating system of the computer 2 continually generates graphic commands to display the windows desktop environment on the monitor 14. The filter 8 determines (at block 52) whether there is secondary output provided at blend entry port 26 to display superimposed on the primary output. If not, then there are no graphics to superimpose as a transparency over the primary output and the filter 8 calls (at block 54) the display driver 10 to generate graphics commands for the graphics card 12 to display the primary output in a manner known in the art.

Otherwise, if there is secondary output provided at the blend entry port 26, then the filter 8 determines (at block 56) the display region of the intersection of the secondary output and primary output, i.e., where the two outputs overlap on the display screen. The graphics commands for the secondary output received at the blend entry port 26 would indicate the location in the display region of where to superimpose the secondary output. The filter 8 then calls (at block 58) the blending algorithm to blend the secondary output with the that portion of the primary output that overlaps the display region of the secondary output. The primary output may include not only the content to display in application program window(s) but also content from the operating system of the windows desktop to display. The filter 8 then generates (at block 60) device independent graphics commands to display the blended area of secondary output superimposed over the overlapping primary output and display the non-overlapping portion of the primary output. The filter 8 calls (at block 54) the device driver 10 and passes the graphics commands to display the blended information.

Figure 5:
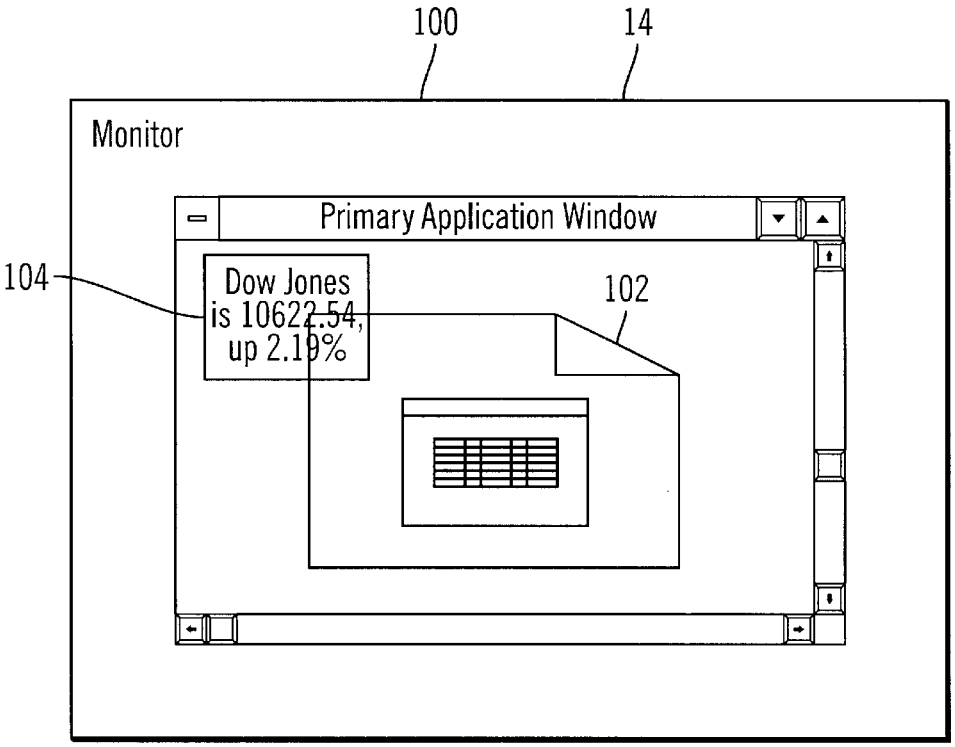
FIG. 5 illustrates how data from two different applications is displayed in accordance with preferred embodiments of the present invention.

FIG. 5 illustrates the result of the filter 8 performing the blending to superimpose the secondary output onto the primary output. In FIG. 5, the primary application window 100 displays the primary output 102 on the monitor 14. The filter 8 receives the secondary output 104, e.g., stock market data, and generates graphic commands to blend the overlapping regions of the secondary output 104 and primary output 102 to cause the display of the secondary output 104 superimposed over the primary output 102 as a transparency, such that the primary content displays through the secondary content, as shown in FIG. 5.

The secondary application may specify blending parameters such as the degree of transparency when superimposing the secondary output over the primary output. Further, the secondary application may specify an opaque transparency where the primary content would not appear through the secondary output. In such case, the opaque display of the secondary output, blocking the overlapping portion of the primary output, would not interfere with any operations the user is performing within the primary application window 100, including selecting regions of the primary application window 100 that are covered by the secondary output 104. Still further, if the overlapping regions of both the primary and secondary outputs are not both totally transparent, then the filter 8 may blend the overlapping colors of the primary and secondary outputs to display a color for the overlapping region that is a mixture of the colors displayed in the intersection of the primary and secondary outputs.

Prior to installation of the filter 8, the display driver 10 would be identified as the display driver shared library object that is used to generate the commands to control the graphics card 12. When the filter 8 is installed, the operating system is reconfigured to identify the filter 8 shared library object as the display driver for the system. Thus, after the filter 8 is installed, the graphics device interface 6 calls the filter 8 instead of the display driver 10. In preferred embodiments, the graphics device interface 6 believes it is calling the display driver 10. In this way, the preferred embodiment superimposition technique can be added to the system as a separate component without requiring alteration of either the operating system, graphical device interface 6 (i.e., graphics engine) or the display driver 10. Instead, in preferred embodiments, the filter is added as a separate component that is called in place of the device driver 10. The device driver entry port 24 thus simulates the entry port of the actual device driver 10.

Application program designers who want to display output as superimposed on another application without affecting the application would add a call to the blend entry port 26 to call the driver instead of the device driver entry port 24. With preferred embodiments, the secondary output is not displayed in a separate window that would affect the operations or access to currently displayed windows, and instead is blended into the content of the currently displayed windows. In this way, preferred embodiments provide and improved mechanism for displaying data in a manner that does not interrupt the activities in which the user is engaged with the currently displayed windows.

Alternative Embodiments and Conclusions

This concludes the description of the preferred embodiments of the invention. The following describes some alternative embodiments for accomplishing the present invention.

The preferred embodiments may be implemented as a method, apparatus or article of manufacture using standard programming and/or engineering techniques to produce software, firmware, hardware, or any combination thereof. The term "article of manufacture" (or alternatively, "computer program product") as used herein is intended to encompass one or more computer programs and/or data files accessible from one or more computer-readable devices, carriers, or media, such as magnetic storage media, "floppy disk," CD-ROM, optical disks, holographic units, volatile or non-volatile electronic memory, etc. Further, the article of manufacture may comprise the implementation of the preferred embodiments in a transmission media, such as a network transmission line, wireless transmission media, signals propagating through space, radio waves, infrared signals, etc. Of course, those skilled in the art will recognize many modifications may be made to this configuration without departing from the scope of the present invention.

In preferred embodiments, the application 4, graphics device interface 6, filter 8, and display driver 10 are implemented as software components and the graphics card 12 is implemented in a chipset including logic to execute drawing instructions to control the monitor 14. In alternative, embodiments, the application 4, graphics device interface 6, filter 8, display driver 10, graphics card 12, and any functional components thereof may be implemented in either software or hardware, or a combination thereof.

In preferred embodiments, the blending algorithm was defined as included in the filter shared library object in a manner that allows the filter to be added to the system without requiring any modification of the operating system or display drivers. However, in alternative embodiments, the software and logic components of the filter, including the blending algorithm, may be implemented entirely in the graphical device interface 6, device driver 8 or graphics card 12, or implemented throughout these other components 6, 8, and 12.

Preferred embodiments describe superimposing secondary output over the primary output of a primary application. The primary application generating the primary output may comprise an application program installed onto the operating system that generates a GUI window providing access to the application controls. Alternatively, the primary application may comprise the operating system generating the desktop environment. In this way, the secondary output may overlap with either the application window or the desktop environment, or a combination of the two.

In preferred embodiments, the display driver that converts device independent display commands to device dependent commands is implemented as a shared library object capable of being executed by multiple application programs. In alternative embodiments, the display driver may be an object other than a shared library object.

In summary, the present invention provides a system, method, and program for displaying data. A program receives first input graphics commands from a first application program to display first output on a display monitor and second input graphics commands from a second application program to display second output on the display monitor. The second output is graphically blended with an overlapping portion of the first output. Output graphics commands are generated from the first and second input graphics commands display the graphically blended second output superimposed over an overlapping portion of the first output and the first output non-overlapping with the second output.

The foregoing description of the preferred embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method for displaying data, comprising:

receiving at a first port of a filter program first input graphics commands from a first application program to display first output on a display monitor;

receiving at a second port of a filter program second input graphics commands from a second application program to display second output on the display monitor;

graphically blending the second output with an overlapping portion of the first output, wherein output related to graphics commands sent to the second port is blended to be displayed superimposed over the overlapping portion of output related to graphics commands sent to the first port, wherein output related to graphics commands sent to the first port is displayed in a separate window; and generating output graphics commands from the first and second input graphics commands to display the graphically blended second output superimposed over the overlapping portion of the first output.

2. The method of claim 1, wherein the generated output graphics commands are device independent graphics commands, further comprising sending the output graphics commands to a display driver, wherein the display driver generates device dependent display commands from the output graphics commands to control the monitor.

3. The method of claim 1, further comprising executing a blending algorithm to superimpose the second output with the overlapping portion of the first output, wherein the second output is displayed as a transparency over the first output such that content of the first output is visible through the displayed second output on the display monitor.

4. The method of claim 3, wherein the steps of receiving the first and second input graphics commands, generating the output graphics commands and executing the blending algorithm is performed by the filter program, further comprising the filter program sending the output graphics commands to a display driver.

5. The method of claim 3, wherein the filter program is implemented within a display driver, further comprising the display driver generating device dependent display commands from the output graphics commands to control the monitor.

6. The method of claim 1, wherein the received second input graphics commands further include transparency parameters indicating a degree of transparency at which to superimpose the second output over the first output, wherein generating the output graphics commands further comprises generating the commands to superimpose the second output over the first output with a degree of transparency indicated in the transparency parameters.

7. The method of claim 1, wherein the first application program comprises one of an application program installed onto on an operating system and the operating system, wherein the primary output comprises an application window to provide an interface to the application program if the first application program is an application program and the primary output comprises a desktop environment if the first application program is the operating system.

8. The method of claim 1, wherein the first application program is installed onto the operating system, further comprising receiving third input graphics from the operating system to display third output on the display monitor of a desktop environment, wherein the generated output graphics display the second output superimposed over the first output and the third output.

9. The method of claim 1, further comprising selecting a portion of the displayed first output in response to user input selecting a portion of the graphically blended second output superimposed over an overlapping portion of the first output.

10. A system for displaying data on a display monitor from a first and second application programs, comprising:

a filter program including a first and second ports through which applications send data means for receiving at the first port first input graphics commands from the first application program to display first output on a display monitor;

means for receiving at the second port second input graphics commands from the second application program to display second output on the display monitor;

means for graphically blending the second output with an overlapping portion of the first output such that output related to graphics commands sent to the second port is blended to be displayed superimposed over the overlapping portion of output related to graphics commands sent to the first port, wherein output related to graphics commands sent to the first port is displayed in a separate window; and means for generating output graphics commands from the first and second input graphics commands to display the graphically blended second output superimposed over the overlapping portion of the first output.

11. The system of claim 10, wherein the generated output graphics commands are device independent graphics commands, further comprising means for sending the output graphics commands to a display driver, wherein the display driver generates device dependent display commands from the output graphics commands to control the monitor.

12. The system of claim 10, further comprising means for executing a blending algorithm to superimpose the second output with the overlapping portion of the first output, wherein the second output is displayed as a transparency over the first output such that content of the first output is visible through the displayed second output on the display monitor.

13. The system of claim 12, wherein the means for receiving the first and second input graphics commands, generating the output graphics commands and executing the blending algorithm is performed by the filter program, and wherein the filter includes means for sending the output graphics commands to a display driver.

14. The system of claim 12, wherein the filter program is implemented within a display driver, wherein the display driver includes means for generating device dependent display commands from the output graphics commands to control the monitor.

15. The system of claim 10, wherein the received second input graphics commands further include transparency parameters indicating a degree of transparency at which to superimpose the second output over the first output, wherein the means for generating the output graphics commands further comprises generating the commands to superimpose the second output over the first output with a degree of transparency indicated in the transparency parameters.

16. The system of claim 10, wherein the first application program comprises one of an application program installed onto on an operating system and the operating system, wherein the primary output comprises an application window to provide an interface to the application program if the first application program is an application program and the primary output comprises a desktop environment if the first application program is the operating system.

17. The system of claim 10, wherein the first application program is installed onto the operating system, further comprising receiving third input graphics from the operating system to display third output on the display monitor of a desktop environment, wherein the generated output graphics display the second output superimposed over the first output and the third output.

18. The system of claim 1, further comprising means for selecting a portion of the displayed first output in response to user input selecting a portion of the graphically blended second output superimposed over an overlapping portion of the first output.

19. An article of manufacture for displaying data, the article of manufacture comprising computer useable media accessible to the computer system, wherein the computer usable media includes at least one computer program, including a filter program, that is capable of causing the computer system to perform:

receiving first input graphics commands at a first port of the filter program from a first application program to display first output on a display monitor;

receiving second input graphics commands at a second port of the filter program from a second application program to display second output on the display monitor;

graphically blending the second output with an overlapping portion of the first output such that output related to graphics commands sent to the second port is blended to be displayed superimposed over the overlapping portion of output related to graphics commands sent to the first port, wherein output related to graphics commands sent to the first port is displayed in a separate window; and generating output graphics commands from the first and second input graphics commands to display the graphically blended second output superimposed over the overlapping portion of the first output.

20. The article of manufacture of claim 19, wherein the generated output graphics commands are device independent graphics commands, further comprising sending the output graphics commands to a display driver, wherein the display driver generates device dependent display commands from the output graphics commands to control the monitor.

21. The article of manufacture of claim 19, further comprising executing a blending algorithm to superimpose the second output with the overlapping portion of the first output, wherein the second output is displayed as a transparency over the first output such that content of the first output is visible through the displayed second output on the display monitor.

22. The article of manufacture of claim 21, wherein the steps of receiving the first and second input graphics commands, generating the output graphics commands and executing the blending algorithm is performed by the filter program, further comprising the filter program sending the output graphics commands to a display driver.

23. The article of manufacture of claim 21, wherein the filter program is implemented within a display driver, further comprising the display driver generating device dependent display commands from the output graphics commands to control the monitor.

24. The article of manufacture of claim 19, wherein the received second input graphics commands further include transparency parameters indicating a degree of transparency at which to superimpose the second output over the first output, wherein generating the output graphics commands further comprises generating the commands to superimpose the second output over the first output with a degree of transparency indicated in the transparency parameters.

25. The article of manufacture of claim 19, wherein the first application program comprises one of an application program installed onto on an operating system and the operating system, wherein the primary output comprises an application window to provide an interface to the application program if the first application program is an application program and the primary output comprises a desktop environment if the first application program is the operating system.

26. The article of manufacture of claim 19, wherein the first application program is installed onto the operating system, further comprising receiving third input graphics from the operating system to display third output on the display monitor of a desktop environment, wherein the generated output graphics display the second output superimposed over the first output and the third output.

27. The article of manufacture of claim 19, further comprising selecting a portion of the displayed first output in response to user input selecting a portion of the graphically blended second output superimposed over an overlapping portion of the first output.

28. A method for displaying data, comprising:

receiving first input graphics commands from a first application program to display first output on a display monitor;

receiving second input graphics commands from a second application program to display second output on the display monitor;

displaying the second output superimposed over at least a portion of the first output; wherein the second output displayed superimposed over an overlapping portion of the fist output and the first output non-overlapping with the second output are displayed in a single active graphical window, and wherein the first output overlapping with the second output is directly accessible to a user through the graphical window;

receiving user input from an input device action performed with respect to an area of the secondary output superimposed over the primary output; and executing, in response to the user input, a command associated with the primary output within the area.

29. The method of claim 28, wherein the user input comprises a single input device action, whereby the single input device action causes the selection of the portion of the displayed first output.

30. A system for displaying data on a display monitor, comprising:

means for receiving first input graphics commands from a first application program to display first output on a display monitor;

means for receiving second input graphics commands from a second application program to display second output on the display monitor;

means for displaying on the display monitor the second output superimposed over at least a portion of the first output, wherein the second output displayed superimposed over an overlapping portion of the first output and the first output non-overlapping with the second output are displayed in a single active graphical window, and wherein the first output overlapping with the second output is directly accessible to a user through the graphical window;

means for receiving user input from an input device action preformed with respect to an area of the secondary output superimposed over the primary output; and means for executing, in response to the user input, a command associated with the primary output within the area.

31. The system of claim 30, wherein the user input comprises a single input device action, whereby the single input device action causes the selection of the portion of the displayed first output.

32. An article of manufacture for displaying data, the article of manufacture comprising computer useable media accessible to the computer system, wherein the computer usable media includes at least one computer program that is capable of causing the computer system to perform:

receiving first input graphics commands from a first application program to display first output on a display monitor;

receiving second input graphics commands from a second application program to display second output on the display monitor;

displaying the second output superimposed over at least a portion of the first output, wherein the second output displayed superimposed over an overlapping portion of the first output and the first output non-overlapping with the second output are displayed in a single active graphical window, and wherein the first output overlapping with the second output is directly accessible to a user through the graphical window;

receiving user input from an input device action performed with respect to an area of the secondary output superimposed over the primary output; and executing, in response to the user input, a command associated with the primary output within the area.

33. The article of manufacture of claim 32, wherein the user input comprises a single input device action, whereby the single input device action causes the selection of the portion of the displayed first output.

* * * * *

UNITED STATES PATENT AND TRADEMARK OFFICE

CERTIFICATE OF CORRECTION

PATENT NO. : 6,538,660 B1
DATED : March 25, 2003
INVENTOR(S) : Joseph Celi, Jr. et al.

It is certified that error appears in the above-identified patent and that said Letters Patent is hereby corrected as shown below:

Column 10,
Line 43, delete ";" and insert -- , --.

Signed and Sealed this

Fourteenth Day of October, 2003

JAMES E. ROGAN
*Director of the United States Patent and Trademark Office*